United States Patent [19]

Steele, Jr.

[11] Patent Number: 4,768,528

[45] Date of Patent: Sep. 6, 1988

[54] FINGER GUIDE PRECISION HAIRCUTTING TOOL

[76] Inventor: Vernon P. Steele, Jr., 2701 Dantzler St., Moss Point, Miss. 39563

[21] Appl. No.: 12,142

[22] Filed: Feb. 9, 1987

[51] Int. Cl.[4] ..... A45D 24/36

[52] U.S. Cl. ..... 132/45 R; D28/10

[58] Field of Search ..... 132/45 R, 45 A; D28/9, D28/10

[56] References Cited

U.S. PATENT DOCUMENTS

| | | | |
|---|---|---|---|
| 2,879,778 | 3/1959 | Peck | 132/45 R |
| 3,972,337 | 8/1976 | Pomaro | 132/45 R |
| 3,993,083 | 11/1976 | Torres | 132/45 R |
| 4,269,205 | 5/1981 | Clark et al. | 132/45 R |

FOREIGN PATENT DOCUMENTS

| | | | |
|---|---|---|---|
| 3200394 | 12/1982 | Fed. Rep. of Germany | 132/45 R |
| 2435926 | 5/1980 | France | 132/45 R |

*Primary Examiner*—Paul J. Hirsch
*Assistant Examiner*—Adriene J. Lepiane

[57] ABSTRACT

A precision haircutting tool primarily designed to facilitate the cutting of one's own hair or someone else's hair easily and uniformly. The thumb of the hand used to hold the hair for cutting is slipped through the thumb ring and the finger guide (or stem) is allowed to extend between the index and 2nd fingers of the same hand. The hair is then combed upwards with the opposite hand and the hair is grasped between the same index and 2nd fingers between which the finger guide is being held. With the thumb resting on the head, the fingers are then slid up the stem to the finger stop and the protruding hair is cut above the fingers. By following a systematic pattern, the hair can be easily cut to the same length all over the head. By using various sizes of the device, a variety of hair lengths or combinations of hair lengths can be attained.

1 Claim, 1 Drawing Sheet

FINGER GUIDE PRECISION HAIRCUTTING TOOL

FIELD OF INVENTION

This invention relates to haircutting aids and specifically to a device that would allow an inexperienced person to cut his or her own hair or someone else's hair easily and uniformly.

DISCUSSION OF PRIOR ART

Heretofore, there has never been, on the commercial market, a device that would allow the "home barber" to easily give either his or her self or a family member a full haircut without the fear of cutting it unevenly. Although there are some devices that are claimed to do this, they usually involve a type of razor comb which does not do the job well at all and can be disastrous if not used exactly right.

The only device which appears to accomplish this task is listed under U.S. Pat. No. 4,269,205 and is called a "Thumb Hair Gage". From the description of this device in the patent drawings, plus the fact that the device has not appeared on the open market, the device apparently has some disadvantages. In comparison to the "Finger Guide" precision haircutting tool described herein, the "Thumb Hair Gage" is more complicated to use as it does not utilize the natural combing and holding motions of the hand, e.g. the fingers have to come down to rest on a "saddle" rather than rise up to a natural "stop" position. In addition, it is more complicated to manufacture because it has more than one part. Another disadvantage is that it has pressure locking devices which will eventually wear out.

OBJECTS

Accordingly, several objects of my invention are: It is extremely easy to use; follows the natural combing and holding motions of the hand; is formed of one-piece construction; and has no parts which will wear out. Further objects and advantages of my invention will become apparent from a consideration of the drawings and ensuing description thereof.

DRAWINGS

DESCRIPTION

The haircutting tool (1) basically comprises a one-piece construction device which includes namely, a thumb ring portion(2), a stem portion(3), and a finger stop portion(4). The device is formed of a resilient material (preferably plastic) which is firm enough to keep the stem portion(3) from bending and resilient enough to allow the thumb ring portion(2) to fit comfortably on a variety of thumb sizes without slipping.

Figure 1:
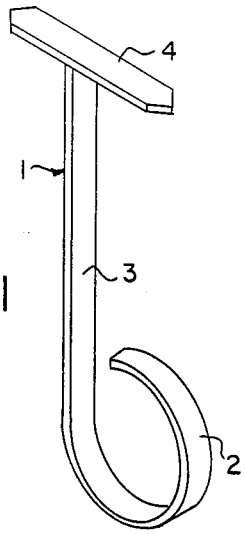
FIG. 1 is a perspective view of the "Finger Guide" haircutting tool of the present invention.
Figure 2:
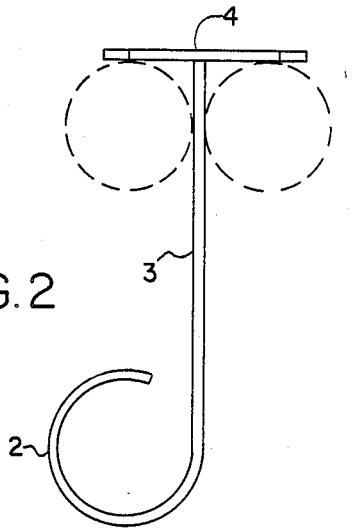
FIG. 2 is a side elevational view of the haircutting tool in use in a typical manner.

The thumb ring portion(2) is formed into an unclosed circle (similar to a guitar thumb pick) and allows the device to be easily slipped over the end of the thumb with the stem portion(3) extending upwards between the index and 2nd fingers as illustrated in FIG. 2. The device can be used on either hand. The stem portion(3) extends in a straight line between the thumb ring portion(2) and the finger stop portion(4) and serves to guide the fingers upwards to the finger stop portion (4). The finger stop portion(4) consists of a horizontal member formed on top of and perpendicular to the stem portion(3) and extending an equal distance outward on both sides of the stem portion(3) far enough to comfortably stop the upwards motion of the fingers when slid up to the top of the stem portion(3). The finger stop portion(4) may be contoured to fit the tops of the fingers.

OPERATION

Figure 3:
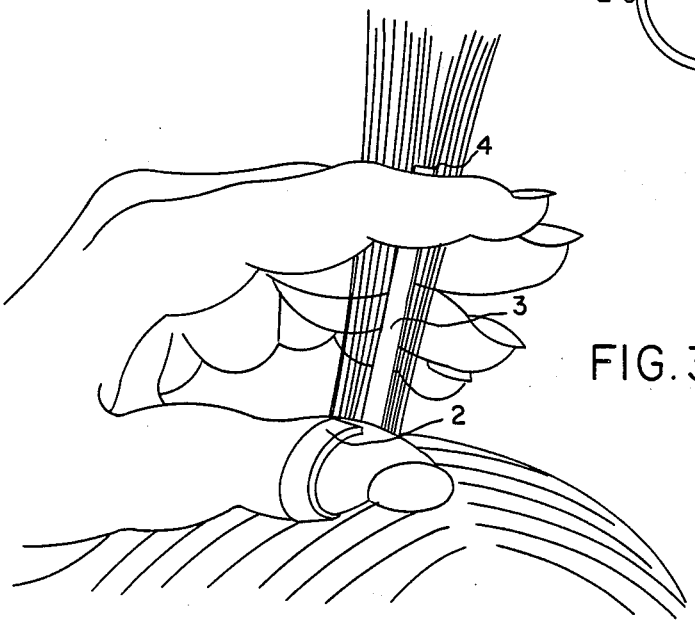
FIG. 3 is a perspective view of the haircutting tool in use in a typical manner.

In use, as seen in FIGS. 2 & 3, the thumb ring portion(2) is snugly attached to the thumb of the hand used for holding the hair just in front of the first joint. The stem portion(3) is held so that it projects between the index finger and the 2nd finger of the same hand. As the hair is combed upwards with the opposite hand, the hair is grasped between the same index and 2nd fingers between which the stem portion(3) is being held. The thumb, which is extending through the thumb ring portion(2), is then placed against the head and the fingers are slid upwards until they reach the finger stop portion(4). The hair is then cut just above the fingers. By following a set pattern, this comb, hold, and cut process can be used to cut the hair precisely to the same length all over the head using the natural haircutting motions of the hand and fingers.

While the above description contains many specificities, these should not be construed as limitations on the scope of the invention, but rather as an exemplification of one preferred embodiment thereof. Other variations are possible, for example: The stem portion(3) may be made easily adjustable although this would complicate the manufacture of the device and introduce parts which would wear out. In addition, the finger stop portion(4), as previously mentioned, could be made arcuate in shape to better fit the contour of the tops of the fingers. The ends of the finger stop portion(4) could also be tapered to allow easy slippage through the strands of the hair. It should also be considered that the device is not limited to cutting hair but could be used to provide a quick and repetitive hand measurement for any process which it would lend itself to.

The "Finger Guide" precision haircutting tool simply, accurately, and repeatably controls the distance that the fingers will be moved upwards from the thumb which is resting on the head. With minimum practice, the user of the "Finger Guide" will be able to cut his or her own hair uniformly all over the head strictly by feel. By manufacturing the device in a series of different lengths per package, a wide variety of hair lengths or combinations of hair lengths can be attained.

What is claimed is:

1. A one-piece construction, thumb-attachable haircutting tool comprising:

(a) A self-adjusting ring porition for comfortably and easily attaching to the thumb and capable of expanding to fit a wide variety of thumb sizes;

(b) A stem portion for guiding the fingers upwards from the thumb, and whose length determines the length at which the hair will be cut; and (c) A finger stop consisting of a horizontal member formed on top of and perpendicular to said stem portion to stop the upward motion of the fingers at a pre-determined distance from the thumb.

* * * * *